US006510573B1

(12) United States Patent
Grabe

(10) Patent No.: US 6,510,573 B1
(45) **Date of Patent: *Jan. 28, 2003**

(54) AIR CUSHION WITH INDEPENDENTLY ADJUSTABLE RESILIENT ZONES

(76) Inventor: Kurtis F. Grabe, 29 Lakewood, Belleville, IL (US) 62223

( * ) Notice: Subject to any disclaimer, the term of this patent is extended or adjusted under 35 U.S.C. 154(b) by 99 days.

This patent is subject to a terminal disclaimer.

(21) Appl. No.: 09/653,293

(22) Filed: Aug. 31, 2000

Related U.S. Application Data

(63) Continuation-in-part of application No. 09/515,265, filed on Feb. 29, 2000, now Pat. No. 6,189,168.

(51) Int. Cl.[7] ..... A47G 9/00

(52) U.S. Cl. ..... 5/644; 5/655.3; 5/645; 5/490

(58) Field of Search ..... 5/626, 640, 644, 5/645, 655.3, 490, 706, 710, 713, 654

(56) References Cited

U.S. PATENT DOCUMENTS

| | | | | |
|---|---|---|---|---|
| 2,434,641 A | | 1/1948 | Burns | |
| 3,192,540 A | * | 7/1965 | Swank | 137/223 |
| 3,251,075 A | | 5/1966 | Saltness et al. | |
| 5,111,544 A | | 5/1992 | Graebe | |
| 5,596,781 A | | 1/1997 | Graebe et al. | |
| 5,689,845 A | | 11/1997 | Sobieralski | |
| 5,708,999 A | | 1/1998 | Priolo et al. | |
| 5,839,140 A | * | 11/1998 | Wilkerson | 5/653 |
| 6,047,425 A | | 4/2000 | Khazaal | |
| 6,189,168 B1 | * | 2/2001 | Graebe | 5/490 |

* cited by examiner

*Primary Examiner*—Michael F. Trettel
(74) *Attorney, Agent, or Firm*—Thompson Coburn LLP

(57) ABSTRACT

An air cell pillow includes an air cushion and a cover. The air cushion is encased by a cover that has a top, bottom and four side panels arranged generally in a box shape. The top and bottom panels each have a first thickness and the side panels each have a second thickness. The first thickness is greater than the second thickness. The first thickness provides a smooth, continuous surface atop the independent air cells of the cushion and the second thickness allowing the pillow to readily collapse upon application of a load to the top and bottom panels. The air cushion has separate zones that may be independently adjusted to vary the resiliency in each zone. The cushion has a base sheet and a top sheet. The top sheet is molded in the form of a plurality of air cells that are secured to and extend outwardly from the base sheet. The plurality of air cells includes a portion of the air cells that form a first inflation zone adjacent a perimeter edge of the cushion and a remaining portion that form a second inflation zone. The first inflation zone is isolated from the remainder of the air cushion and is separately inflatable whereby the first inflation zone has a resiliency that may be adjusted independently from the remainder of the air cushion when the cushion is inflated.

22 Claims, 7 Drawing Sheets

AIR CUSHION WITH INDEPENDENTLY ADJUSTABLE RESILIENT ZONES

RELATED APPLICATION DATA

This application is a continuation-in-part of application Ser. No. 09/515,265 filed on Feb. 29, 2000 now U.S. Pat. No. 6,189,168.

BACKGROUND OF THE INVENTION (1) Field of the Invention

The present invention relates to a type of pillow comprised of a cover and an air cell cushion. The cover is designed to collapse to produce a more comfortable pillow for the user.

(2) Description of the Related Art

Various attempts have been made over the years to create a pillow that provides the utmost comfort and therapeutic care for the user. These pillows have sought to reduce or correct neck and back discomfort for a person while they sleep. Many pillows in the art use a variety of contours, shapes, and materials to produce a comfortable positioning device for the person's head. These contouring devices are designed to distribute the load of a person's body while in the reposing position to reduce muscle strain and tension along the head, neck, and shoulders region of the body.

In the simplest design, the pillow is an easily deformable cushion, providing moderate support for the user's head and neck. Generally, the cushion is made from materials such as foam, polyethylene chips, goose down, horse hair, or some other easily deformable material. However, the common characteristics of these pillows is that the pillows may be too soft and too easily deformable for some users. Often the user has to "fluff up" their pillow to build up its relative resiliency. Unfortunately, during the course of a night, this resiliency is decreased, causing the pillow to lose its support. It is at this time that the user may experience undue stress on certain parts of the body, resulting in general discomfort, which may transmit throughout the body. Pillow cases of the prior art were designed to cover and protect the pillow and did not provide any shape or support function.

Newer designs of pillow construction have employed resilient underlying base materials that enable the pillow to generally maintain its shape under load. In the past, pillows of this category have used common foam materials formed with successive crossing layers of grooves and risers to create softness yet support for the pillow. More recent designs use foam materials with a system of contours in the cushion to supply support for the user. In these pillows, the contours are designed to limit the amount of deformation while supplying support as the person's head is cradled or supported in the pillow. Generally, these contours are formed in the natural shape of the person's head, neck, and shoulder regions for supine positions so that an even distribution of pressure is applied to these areas of the body so as to reduce undue strain and other stresses along the musculature of the spine. Often these contoured designs also utilize a convoluted surface to selectively control the resiliency in an area of the pillow. However, as a person moves during sleep, the person's body becomes misaligned with the preset contour of the pillow. This sometimes creates discomfort for the user. Additionally, the materials used as the base materials for these pillows must have sufficient structure to allow it to be formed in a contoured or convoluted shape. This structure is often not sufficiently breathable so as to permit the removal of moisture and heat from the person's body as they sleep. Thus, for this reason also, the pillow sometimes results in discomfort of the individual.

SUMMARY OF THE INVENTION

What is needed to overcome the disadvantages of prior art pillows is a pillow that is sufficiently firm to provide support, but yet is resilient enough to properly cradle and conform to a person's neck, head, and shoulders so as to prevent undue strain on these areas. Such a pillow would easily conform to the person's body as the person moves and positions themselves differently on the pillow. Moreover, such a pillow would be low cost, made from hypoallergenic materials, and have a firmness that is selectively adjustable for the individual's desired level of comfort.

In the past, it has been shown that an air mattress readily conforms to the shape of the part of the person's body which it supports. Air cells also provide a sufficient amount of resiliency that can be selectively controlled by air pressure inside the cell. The present invention combines the advantages of the air cells with a new cover to provide a maximum amount of support and comfort for the user.

In the preferred embodiment, the pillow is comprised of an air cushion contained in a padded cover. The air cushion is comprised of a plurality of air cells. The air cells are interconnected to permit air to flow between the cells. The air cells can be connected to a pump to inflate the air cells and a device to vary the pressure within the air cells. In the preferred embodiment, the air cushion is designed with two sections of air cells that extended outwardly and opposite each other to provide the maximum amount of contouring and comfort for the user regardless of which side of the air cushion is being used.

The cover for the pillow is generally shaped as a box having top and bottom panels with four peripheral sides extending between the top and bottom panels. The top panel of the cover may be padded to provide a smooth, continuous surface over the air cells. Alternately, both the top and bottom panels may be padded so that the pillow may be flipped over without a discernible difference in the level of comfort regardless of which side of the pillow is in use. The side panels of the cover are unpadded to allow the sides to readily collapse upon application of a load to the top and bottom panels and to reduce the amount of material that could bunch-up underneath the neck of a user when their head is resting on the pillow. Alternately, the cover may also be constructed of a stretchable fabric that tightly conforms to the air cushion. The use of stretchable fabric prevents the side panels of the cover from excessively bunching up underneath the neck of a user when a load is applied to the top and bottom panels. Preferably, the cover is made from a fabric that is sufficiently breathable and carries heat and moisture away from the body of the user. In the preferred embodiment of the cover, the cover has an access opening through a side panel through which the air cushion is inserted and removed. Additionally, the cover is provided with a button hole to allow an inflation device for the air cushion to be directed from within the cover to outside the cover. The cover may also have pockets to contain the inflation device and to provide the user with ready access to the inflation device.

The air cell cushion preferably has separate zones that may be independently adjusted by the user to control the amount of firmness and resiliency in the pillow. One Inflation zone is formed adjacent the perimeter edge of the inflatable cushion. Each of the inflation zones is isolated from the others and each is connected to an inflation pressure adjustment mechanism. The arrangement permits the user to set the inflation pressure in each inflation zone when the inflatable cushion is inflated.

In one embodiment of the invention, the inflatable cushion includes a base sheet and a top sheet. The top sheet is molded in the form of a plurality of air cells that are secured to the base sheet and extend outwardly from the base sheet. The plurality of air cells are grouped to form a primary inflation zone adjacent the perimeter edge of the inflatable cushion and a secondary inflation zone from the remaining area of the inflatable cushion. The air cells of the primary inflation zone are interconnected to permit air flow between the air cells in the primary inflation zone. The air cells of the secondary inflation zone are interconnected to permit air flow between the air cells in the secondary inflation zone. The primary inflation zone is isolated from the secondary inflation zone and separately inflatable from the secondary inflation zone. Thus, the inflatable pad has a primary inflation zone with a resiliency that is adjustable and set independently of the resiliency of the secondary inflation zone when the cushion is inflated.

In another embodiment of the invention, the air pillow includes an inflatable cushion having first and second base sheets and first and second top sheets. The first and second base sheets are positioned side-by-side. The first and second top sheets are each molded in a form of a plurality of independent air cells that are secured to the respective first and second base sheets and extend outwardly in opposite directions from the first and second base sheets. The air cells are grouped into a plurality of sections with at least one section being formed along a perimeter edge of the inflatable cushion. Each of the sections is separated from the other sections in a manner to prevent communication between the sections. Thus, each section has an associated firmness that may be adjusted by the user as required to achieve the desired level of comfort.

The inflatable cushion may also be folded along a fold line to position portions of the base sheet in the side-by-side arrangement and to position the air cells of the primary inflation zone on the perimeter edge of the air cushion. The pair of base sheets may be held in the side-by-side arrangement by releasable fasteners.

BRIEF DESCRIPTION OF THE DRAWINGS

Further objectives and features of the invention are revealed in the following detailed description of the preferred embodiment of the Invention and in the drawing figures wherein.

Corresponding reference characters indicate corresponding parts throughout several views of the drawings.

DETAILED DESCRIPTION OF THE INVENTION

Figure 1:
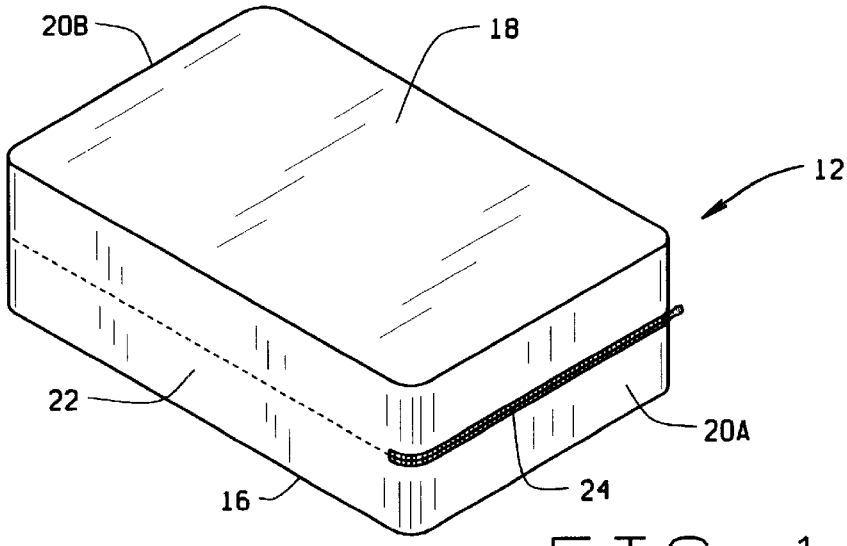
FIG. 1 is a perspective view of a cover for the pillow of the present invention with a zipper opening shown on one side panel.

The pillow of the present invention is generally indicated by reference numeral 10. The pillow 10 is comprised of a cover, generally indicated by reference numeral 12, and an air cushion, generally indicated by reference numeral 14.

Figure 2:
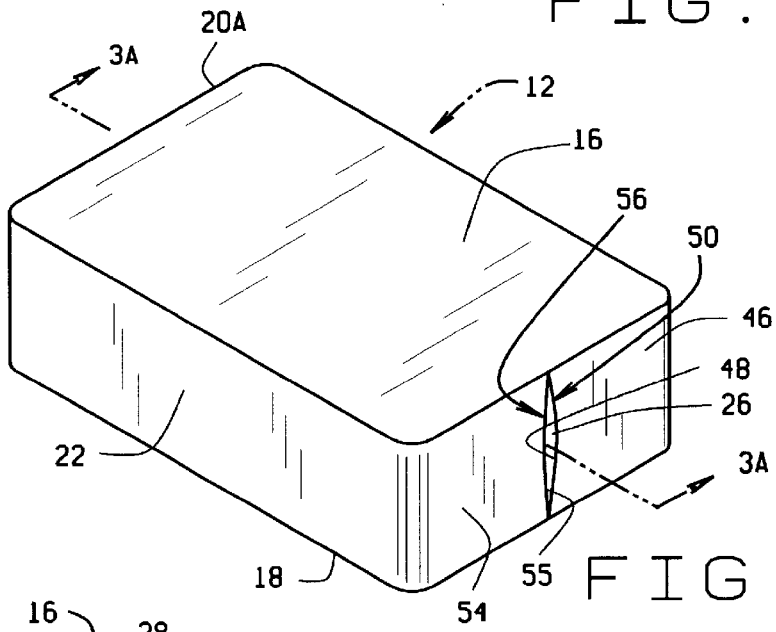
FIG. 2 is a perspective view of the cover of FIG. 1 turned over so as to show a slit opening on the opposite side panel from the zipper opening shown in the cover of FIG. 1.

FIGS. 1 and 2 show the general construction of the cover 12 of the present invention. The cover 12 consists of a top panel 16 and bottom panel 18 with two end panels 20A, 20B and two side panels 22 extending therebetween. Muslin or other light-weight and washable fabric may be used for the construction of the six panels. Each of the six panels has an outer perimeter edge that gives each panel a rectangular configuration. The outer perimeter edges of each of the end panels 20A, 20B and side panels 22, and the outer perimeter edges of each of the top panel 16 and bottom panel 18 are sewn together or secured together by other means to form a generally box-shaped cover.

Figure 3A:
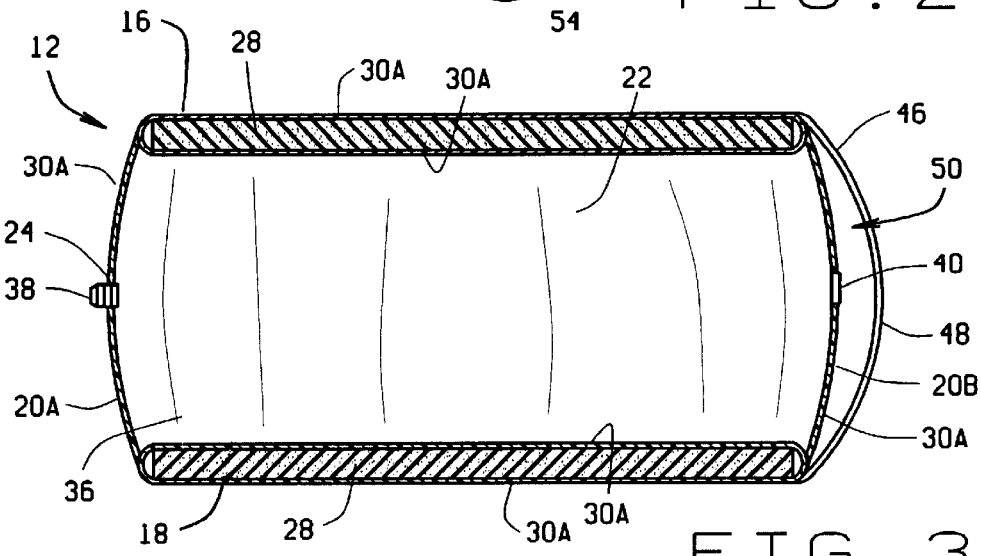
FIG. 3A is a cross-sectional view of the cover taken along the plane of lines 3A—3A of FIG. 2.
Figure 3B:
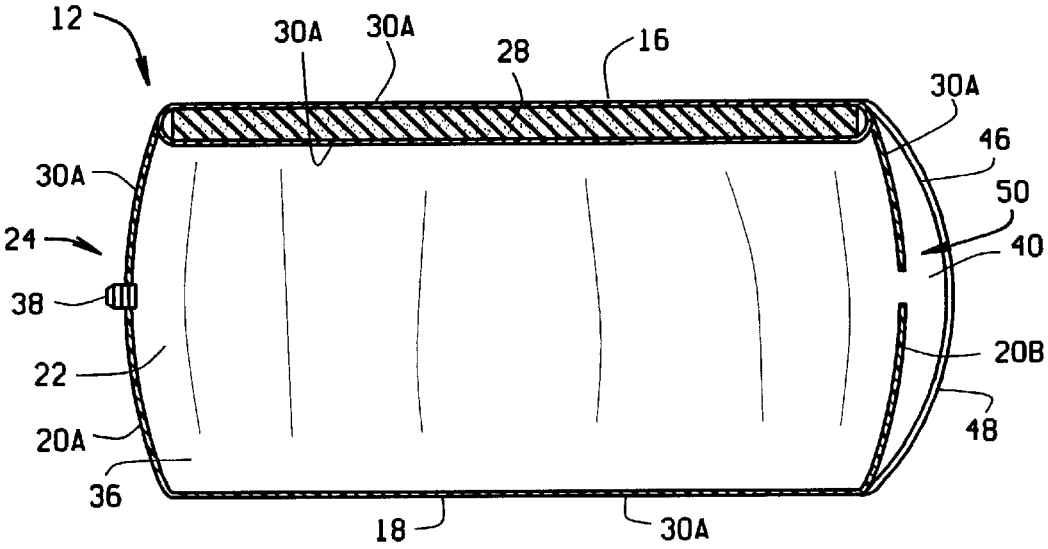
FIG. 3B is a cross-sectional view of an alternate embodiment of the cover of FIG. 3A.

In one embodiment of the cover 12, shown in FIG. 3A, the top panel 16 and bottom panel 18 each contain a layer of batting 28 or other equivalent type of padding. The layer of batting 28 is preferably contained between two layers of fabric 30A to protect the layer of batting 28 and contain the batting 28 within each of the top panel 16 and bottom panel 18. In an alternate embodiment of the cover 12, shown in FIG. 3B, only the top panel 16 contains the batting layer 28 and the bottom panel is formed without the batting layer. This gives the user the option to either use the padded top panel 16 or the unpadded bottom panel 18 for resting the head, neck and shoulders. In the embodiments of the covers shown in FIGS. 3A and 3B, the layer of batting 28 in each of the top panels 16 gives the top panel a first thickness. In the cover shown in 3A, the bottom panel 18 preferably contains a layer of batting 28 of the same thickness as the layer in the top panel 16, so that the user does not discern a difference in the padding when the pillow 10 is flipped over during use. Thus in this construction, the bottom panel 18 also has a first thickness.

Preferably, the batting 28 is a polyester fiber, non-hypoallergenic type filler material common in pillows and other clothing apparel. Cotton or other materials may also be used for the batting 28 without departing from the scope of the invention with the primary considerations being the material's ability to dissipate heat and moisture while providing comfort to the user.

Preferably, the end panels 20A, 20B and side panels 22 are each constructed with a single layer 30 of fabric of similar weight to that used in the top and bottom panels 16, 18 with no batting. More preferably, the end panels 20A, 20B and the side panels 22 are constructed from two layers of fabric arranged face-to-face such that the end panels 20A, 20B and the side panels 22 can be formed from the same layers of fabric used in the top and bottom panels 16, 18. Other methods of forming the end panels 20A, 20B and the side panels 22 may be used with different combinations of fabric layers without departing from the scope of the invention where the fabric layer or layers 30 used for the end panels 20A, 20B and the side panels 22 gives each of the end panels 20A, 20B and the side panels 22 a second thickness that is much smaller than the first thickness of the top panel 16 and the bottom panel 18. Constructing the end panels 20A, 20B and side panels 22 to form the second thickness, allows the pillow 10 to easily buckle or collapse upon application of a load to the top panel 16 or bottom panel 18 with little or no resistance from the end panels 20A, 20B and side panels 22. Providing the minimum amount of fabric material in the end panels 20A, 20B and side panels 22 prevents bunching up of fabric along the sides of the pillow when it is being used that could detract from the comfort of the user.

Figure 7A:
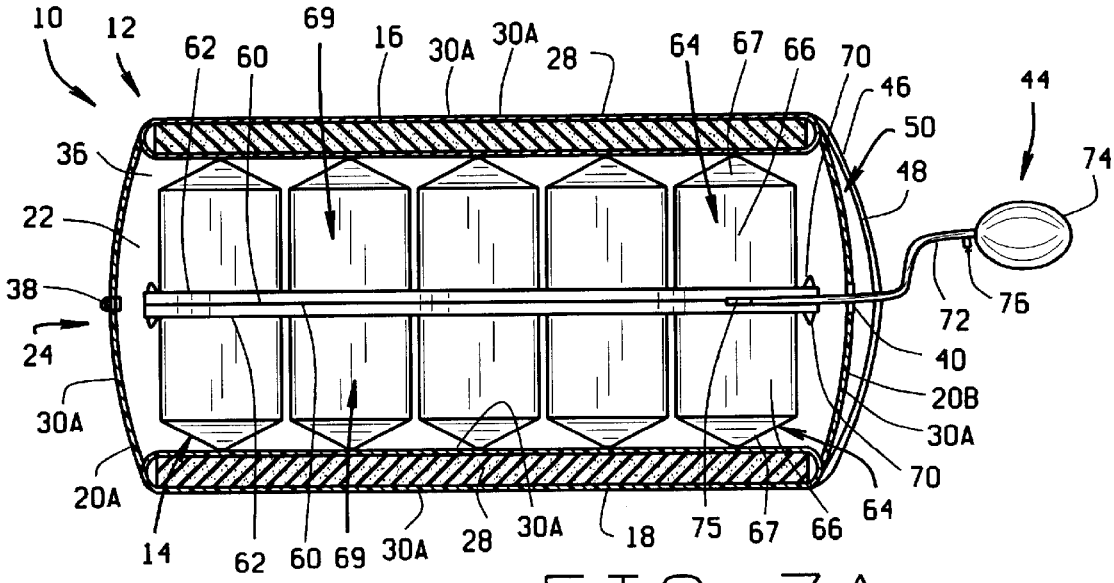
FIG. 7A is a cross-sectional view of the air cushion installed inside the cover taken along the plane of line 7A—7A in FIG. 6 with the inflation device extending from the button hole and the slit opening of the pocket.
Figure 7B:
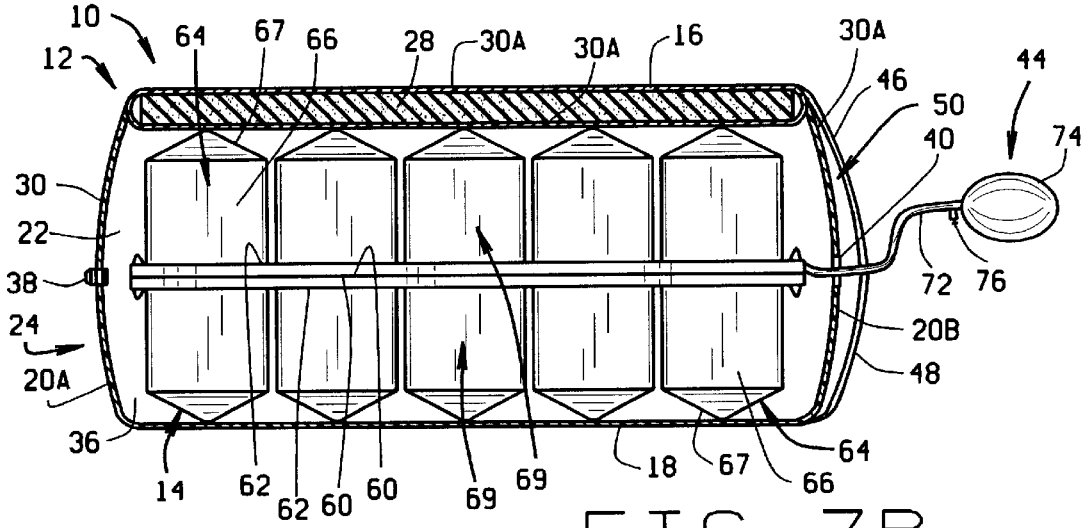
FIG. 7B is a cross sectional view of an alternate embodiment of FIG. 7A showing the cover of FIG. 3B and an alternate embodiment of the air cushion of FIG. 4.
Figure 7C:
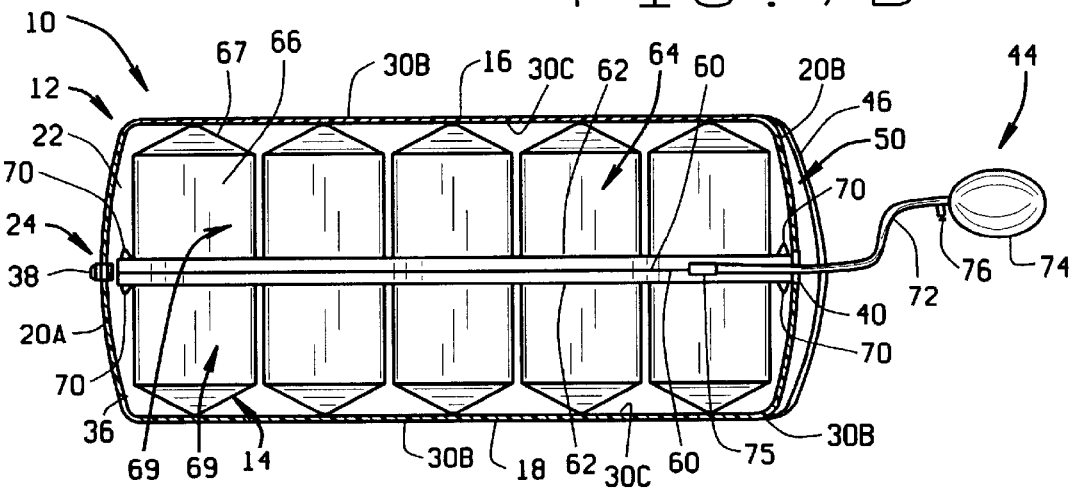
FIG. 7C is a cross sectional view of an alternate embodiment of FIG. 7A showing an alternate embodiment of the cover with the air cushion of FIG. 4 installed.

In another embodiment of the cover shown in FIG. 7C, the cover 12 is made from a stretchable fabric 30B. The fabric 30B may have a blended composition including cotton and spandex fibers to provide the required elasticity and comfort for the user. Because spandex fibers are not generally breathable, the cover 12 may also include a backing layer of fabric 30C in between the stretchable fabric and adjacent the air cushion to provide the maximum amount of breathability, moisture removal, and comfort for the user. Preferably, the stretchable fabric 30B allows the cover 12 to fit tightly around the air cushion 14 when the air cushion 14 is installed in the cover 12. Preferably, the cover 12 stretches tightly around the width of the air cushion 14 so that the fabric 30B for the cover 12 does not bunch up around the users head and neck region when the air cushion is collapsed under load. The cover 12 may have a looser fit around the length of the air cushion 14, since this area does not generally pose a problem of discomfort for the user. The cover 12 of the embodiment of FIG. 7C may be constructed with the batting layers arranged in the top panel 16 and bottom panel 18, in a similar manner to that shown in FIGS. 7A and 7B. The cover 12 shown in FIG. 7C does not use a batting layer in either panel, thus rendering the first thickness equivalent to the second thickness.

As best shown in FIGS. 1 and 2, the cover 12 preferably has an access opening 24 in one of the end panels 20A and a slit opening 26 in the opposite end panel 20B. The access opening 24 provides access into the interior volume 36 of the cover 12 so that the air cushion 14 shown in FIG. 4 can be inserted into the interior volume 36. Preferably, the access opening 24 is aligned parallel to the planes of the top and bottom panels 16, 18 and centered between the top and bottom panels 16, 18. By centering the access opening 24 on the end panel 20A, the air cushion 14 can be more easily inserted into the interior volume 36 of the cover 12. The access opening 24 may be fitted with a closure mechanism, preferably a zipper 38, to secure the air cushion 14 within the interior volume 36 of the cover and to provide selective access into the interior volume 36 of the cover as desired by the user.

Figure 5:
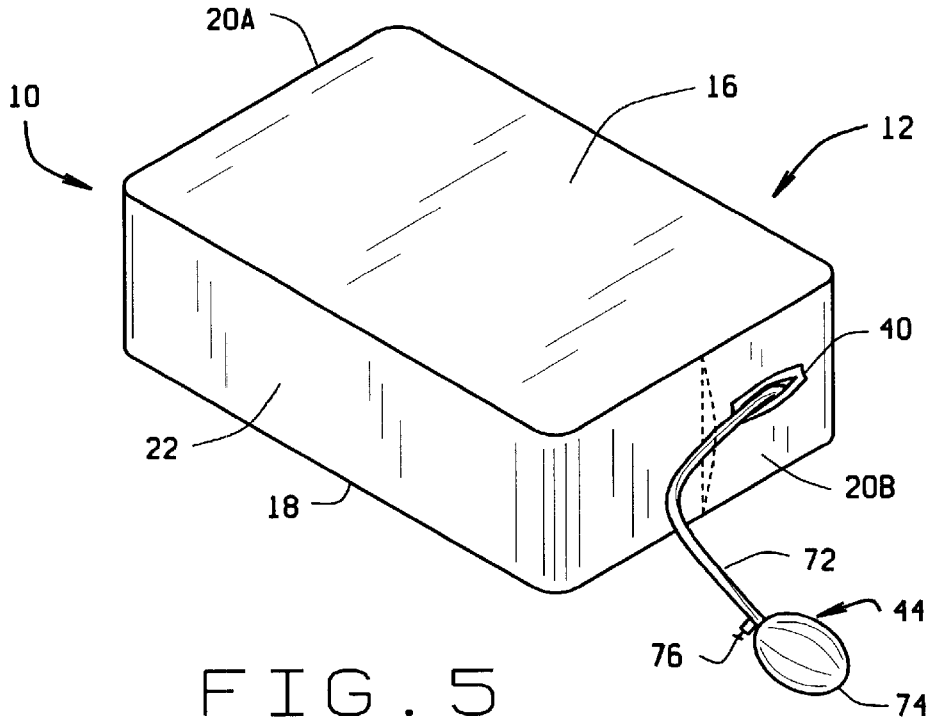
FIG. 5 is a perspective view of the pillow with the air cushion of FIG. 4 installed in the cover of FIG. 2 where a pocket or flap attached to a side panel is shown in dashed lines to show an inflation device extending from a button hole behind the pocket.

Preferably, as shown in FIG. 5, a button hole 40 is provided on the end panel 20B opposite from the zipper 38. The button hole 40 may be aligned parallel to the planes of the top and bottom panels 16, 18 and is preferably centered between the top and bottom panels 16, 18. The button hole 40 is adapted to allow an inflation device, generally indicated as reference numeral 44, to be passed from the interior volume 36 of the cover 12 through the button hole 40 and outside the cover when the air cushion 14 is installed.

Figure 6:
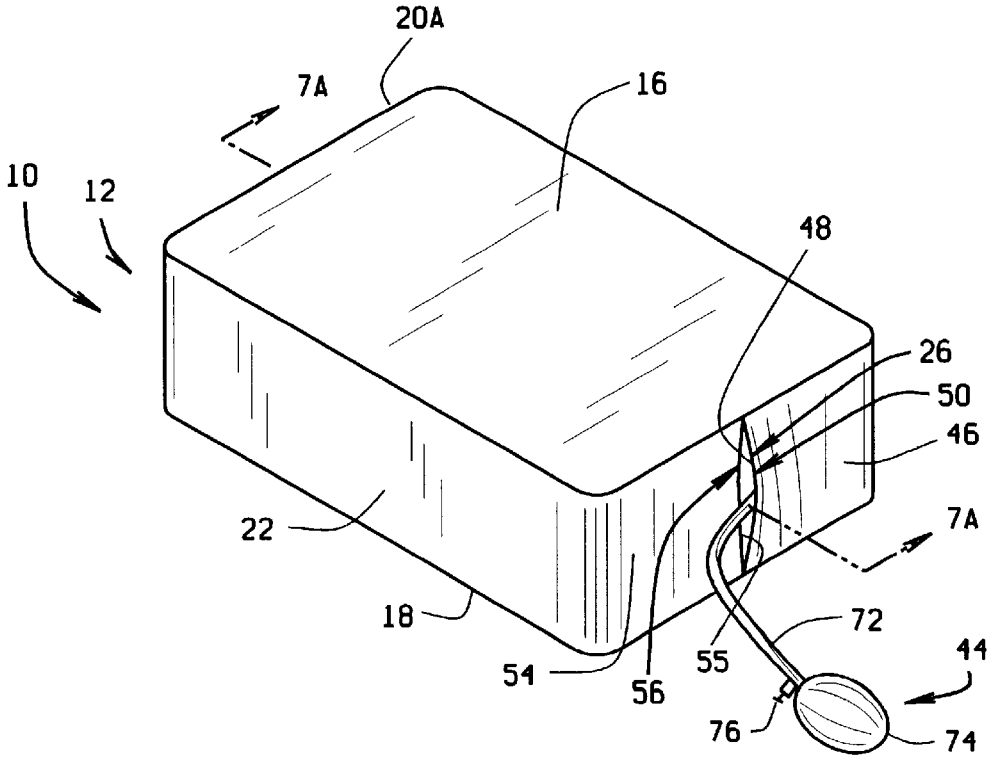
FIG. 6 is a perspective view of the pillow of FIG. 5 showing the location of the pocket or flap and the inflation device extending from a slit opening of the pocket.

Preferably, as shown in FIGS. 2 and 6, the end panel 20B is provided with a first pocket 46 to conceal the button hole. The first pocket 46 is preferably a single-ply, generally rectangular shaped piece of fabric, the same weight as the rest of the cover material. Other thickness combinations and fabric layers for the first pocket 46 may be used as described previously. Three of its four sides are attached to the end panel 20B where portions of the end panel 20B perimeter edges are attached to the portions of the edges of the top panel 16, bottom panel 18, and the adjacent side panel 22. The fourth edge 48 remains unattached, creating a first opening 50 into the pocket 46. The general rectangular shape of the pocket 46 allows it to loosely conform and lay flat against the end panel 20B. In this construction, the button hole 40 may be offset in one direction toward one end of the end panel 20B so that the inflation device 44 may be contained within the first pocket 46. The first opening 50 provides access to the button hole 40 and the interior volume 36 of the cover 12 to assist the user in the installation of the air cushion 14 in the cover 12.

As best shown in FIGS. 2 and 6, a second pocket 54 may also be attached to the same end panel 20B as the first pocket 46 to create a second opening 56 for the second pocket 54 immediately adjacent the first opening 50 of the first pocket 46. The second pocket 54 is preferably attached to the end panel 20B in a similar fashion to that of the first pocket 46, where three sides of a generally rectangular shaped piece of fabric or fabric layers are attached to portions of the perimeter edges of the end panel 20B where the end panel 20B is attached to portions of the top panel 16, bottom panel 18, and the adjacent side panel 22. The fourth edge 55 of the second pocket 54 creates the second opening 56. As seen in FIG. 2, the two free edges 48, 55 of the two pockets 46, 54 are positioned side-by-side. The combination of first 50 and second 56 openings in the pockets 46, 54 creates the vertical slit 26 that is best seen in FIG. 2. The slit 26 is preferably centered on the end panel 20B and is perpendicular to the plane of the top and bottom panels 16, 18. The second pocket 54 may serve as additional stowage space for the inflation device 44.

Figure 4:
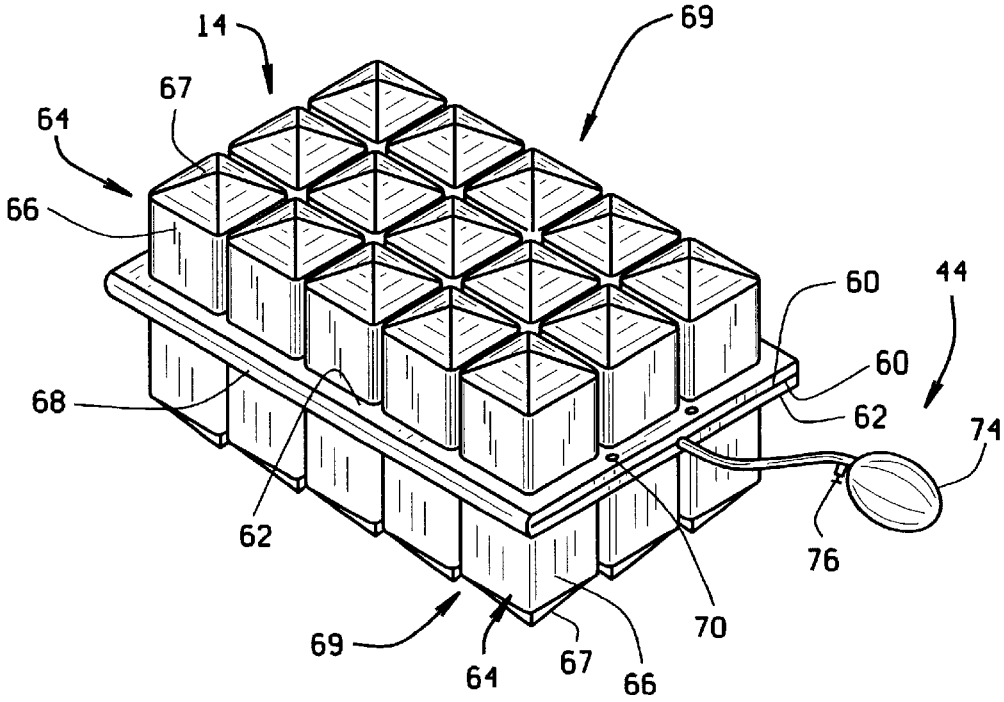
FIG. 4 is a perspective view of an air cushion of the present invention.

Preferably, the air cushion 14 of the present invention, shown in FIGS. 4 and 7, is constructed in a similar manner to that of the air mattress described in U.S. Pat. No. 5,596,781, but in a reduced size. The air cushion is generally comprised of a base sheet 60 and a top 62 sheet, each may be made from an air impervious material such as vinyl or plastic. The top sheet 62 is molded to form a plurality of air cells 64 and is affixed to the flat base sheet 60. The top sheet 62 is affixed to the base sheet 60 around the bottom edges of the air cells to form independent air cells 64, except for portions of the air cell bottom edges that are left open between the top sheet and the bottom sheet to create internal air channels 65 between the top sheet and bottom sheets. The internal air channels provide a path for airflow between the cells. Each cell has a generally cubical shape with four walls 66 extending outwardly from the base sheet 60. A triangular panel 67 extends from the top-most edge of each of the walls and the triangular panels come together to define a pyramidal-type shaped surface at the top of each of the independent air cells 64.

Figure 8A:
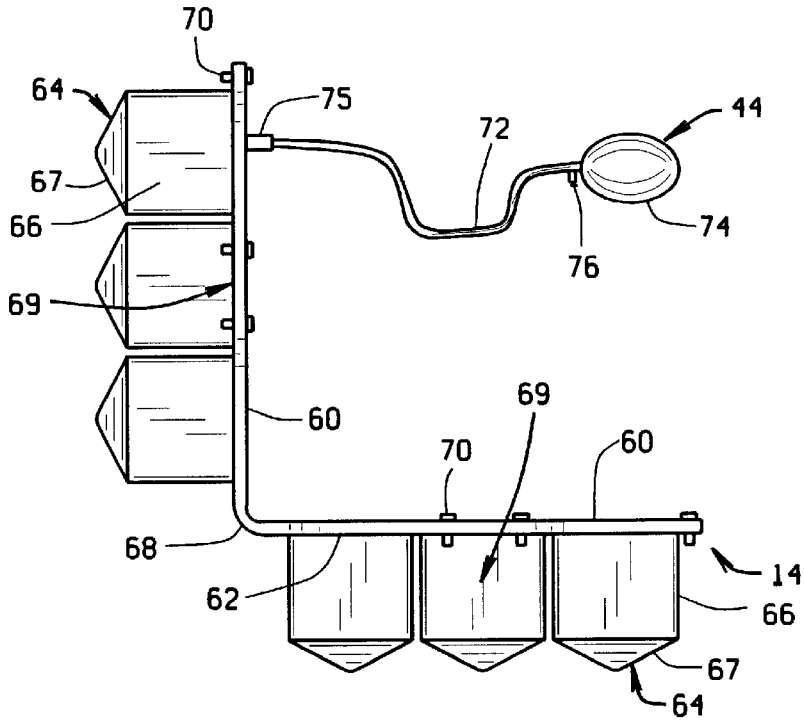
FIG. 8A is a side view of the air cushion of FIG. 4.

In the preferred embodiment shown in FIG. 8A, the air cushion 14 is folded across a fold line 68 between rows of adjacent air cells to create two side-by-side sections 69. The base sheet portions 60 of each section 69 are arranged side-by-side and the independent air cells 64 of each section 69 are arranged extending outwardly, opposite from each other. Despite the fold 68, the air cells remain interconnected by the internal air channels. In this arrangement the air cushion 14 provides the maximum amount of comfort to the user as the pillow 10 can more easily conform to the shape of the user's head, neck, and shoulders regardless of what side of the pillow is being used.

The air cushion 14 folded in the manner described above positions the air cells in a three dimensional array. In FIG. 4, an air cushion of 3×5×2 is formed by folding an air cushion 14 with an array of 6×5×1 air cells in half. The 6×5×1 array is preferred for forming a pillow of conventional size. Other array combinations may be used as required for other desired pillow sizes. For example, an air cushion array of 4×5×1 may be folded over to create an air cushion of 2×5×2 for a smaller, travel-size pillow, or an air cushion array of 4×4×1 may be folded over to create an air cushion of 2×4×2 for a juvenile size pillow. To secure the sections 69 and the base sheets 60 in the side-by-side arrangement, releasable fasteners 70, such as snaps or other types of fasteners, are provided on the perimeter of each of the base sheets 60.

Figure 8B:
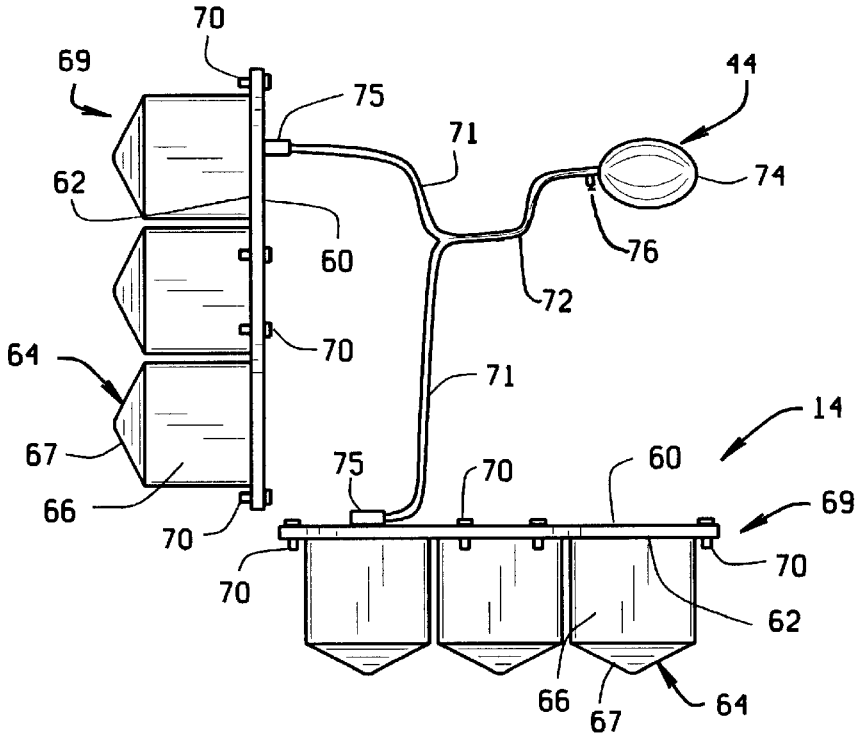
FIG. 8B is a side view of an alternate embodiment of the air cushion of FIG. 8A.

In an alternate construction of the air cushion shown in FIG. 8B, the air cushion is comprised of two independent sections 69 of air cushions interconnected via two lengths of flexible tubing 71. The flexible tubing provides air flow between each section and the internal air channels of each section. The base sheets 60 are placed in the side-by-side arrangement such that the independent air cells 64 of each section 69 extend outwardly, opposite from each other. The snaps 70 hold the sections together and the flexible tubing 71 may be placed in between the adjacent base sheets 60.

To provide air inflation to each embodiment of the air cushion, an inflation device 44 is provided. The inflation device 44 is comprised of a conduit 72 and a bulb pump 74. The conduit 72 is connected to the base sheet of the air cushion and communicates with the internal air channels and each independent air cell. In the embodiment of the air cushion 14 shown in FIG. 8A, the conduit 72 communicates directly with the base sheet 60 of the cushion. Preferably, as shown in FIGS. 7A and 7C, the conduit 72 is mounted to the base sheets by an elbow connection 75 and is positioned in between the base sheet when the base sheet is folded over into the side-by side arrangement and is held in place by the folded base sheet and the fasteners 70. FIG. 8A shows the conduit 72 mounted via the elbow 75 to the underside of the base sheet 60. In an alternate construction shown in FIG. 7B, the conduit 72 is connected to the base sheet 60 at the edge of the base sheet 60. FIG. 8B shows a configuration where the flexible tubing 71 communicates with each of the separate base sheets 60 through a pair of elbows 75 at the underside of the base sheet 60 of each section 69 and two lengths of flexible tubing 71 connected to a "Y" connector.

The inflation device 44 shown in the figures is common in the art and is comprised of the bulb pump 74 and a regulating valve 76. Although the preferred embodiment of the invention shows a manual bulb inflation device 44, other means for supplying pressure may also be used. The user inflates the air cushion 14 by squeezing the bulb pump 74. To lower air pressure or deflate the cushion 14, the user actuates a spring-loaded pressure relief valve 76 that bleeds air from the cushion 14. The inflation device 44 allows the user to control the relative resiliency of the pillow 10 by regulating the air pressure in the air cushion 14. When a manual hand held inflation device such as that shown in the FIGS. is used with the invention, it is preferable to provide the pockets 46, 54 on the end panel 20B of the cover 12 that store the device with the inflation device 44 readily accessible to the user. Other external means for providing inflation may make the pockets unnecessary.

Figure 9:
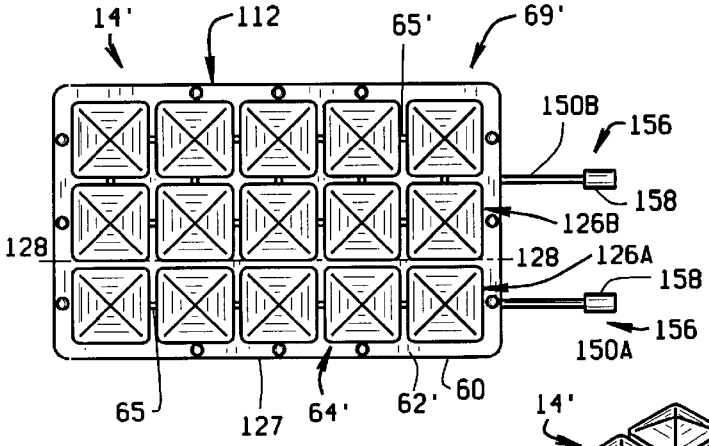
FIG. 9 is a top plan view of an alternate embodiment of the air cushion of FIG. 4.

To illustrate the cooperative relationship between the different aspects of the invention, the installation of the air cushion 14 into the cover 12 will be discussed. The installation is the same for the padded cover and the stretchable cover. Starting from an initial condition where the air cushion 14 is removed from the cover 12 with the air cells 64 deflated and the cushion 14 generally flat, the user accesses the interior volume 36 of the cover 12 by unzipping the access opening 24. The bulb inflation device 44 is inserted through the zippered access opening 24 of the cover 12 and through the button hole 40. Simultaneously, the user accesses the button hole 40 through the slit 26 between the pocket openings and grasps the inflation device 44 to guide it through the button hole 40 and out through the slit 26. The conduit 72 on the inflation device 44 must be long enough to allow the user to guide the inflation device 44 and bulb pump 74 through the button hole 40 and out the slit 26. Once the user pushes the inflation device 44 through the button hole 40, the user can position the air cushion 14 in the interior volume 36 of the cover 12 through the zippered access opening 24. Once the air cushion 14 is fully within the interior volume 36 of the cover 12, the access opening 24 is zipped closed and the user can begin inflation of the air cushion 14.

in an alternate embodiment of the air cushion shown in FIG. 9, the air cushion 14' is constructed with independently adjustable resilient zones. The air cushion 14' of FIG. 9 is constructed with many of the same component parts as the previously described embodiments, and those same component parts are identified by the same reference numerals used in describing the earlier embodiments followed by a prime (') . The air cushion of FIG. 9 has the same general construction as the air cushion shown in FIG. 4 but has air cells 64' grouped together to form inflation zones, the primary inflation zone being indicated at 126A and the secondary inflation zone being indicated at 126B. As in the earlier described embodiments, the air cushion 14' is an inflatable cushion 112 having a rectangular shape that is similar to a common pillow, which a person may use when sleeping. With this primary use in mind, the air cushion shown in FIG. 9 has a portion of its perimeter edge 127 that is intended to be aligned and positioned closely to the user's neck and shoulder regions when sleeping. The remaining area of the air cushion is intended to be used to cradle and support the user's head.

The air cells 64' in the primary inflation zone 126A are isolated from the air cells 64' in the secondary inflation zone 126B by affixing the top sheet 62' to the base sheet 60' without providing the internal air channels that would otherwise connect adjacent air cells in the two zones of the inflatable cushion. Preferably, the inflation zones 126A, 126B are separated by a seal line 128 running between adjacent air cells across the inflatable cushion 112. The seal line 128 runs between adjacent air cells and seals the top sheet 62' to the base sheet 60' without forming the internal air channels. The seal line 128 runs parallel to the portion of the perimeter edge 127 of the air cushion. Thus, the air cells in the primary inflation zone 126A are arranged in a row parallel to the portion of the perimeter edge 127. The air cells in the primary inflation zone 126A are isolated from the air cells in the secondary inflation zone 126B, while the air cells in any one inflation zone remain in communication with the other air cells the same inflation zone.

Because the air cells in the primary inflation zone 126A are isolated from the air cells in the secondary inflation zone 126B across the seal line 128, the air cells 64 in the primary inflation zone 126A adjacent the portion of the perimeter edge 127 of the air cushion may have a pressure that is different from the pressure in the secondary inflation zone 126B. This arrangement enables the user to adjust the level of support for their neck region positioned on the primary inflation zone 126A separately from the level of support for their head positioned on the secondary inflation zone 126B. Although FIG. 9 shows the air cushion having only two inflation zones 126A, 126B, multiple inflation zones may be formed in the inflatable cushion to suit a particular use and treat a patient/user condition. An air cushion having multiple inflation zones would necessarily have multiple seal lines to separate the inflation zones.

Figure 10:
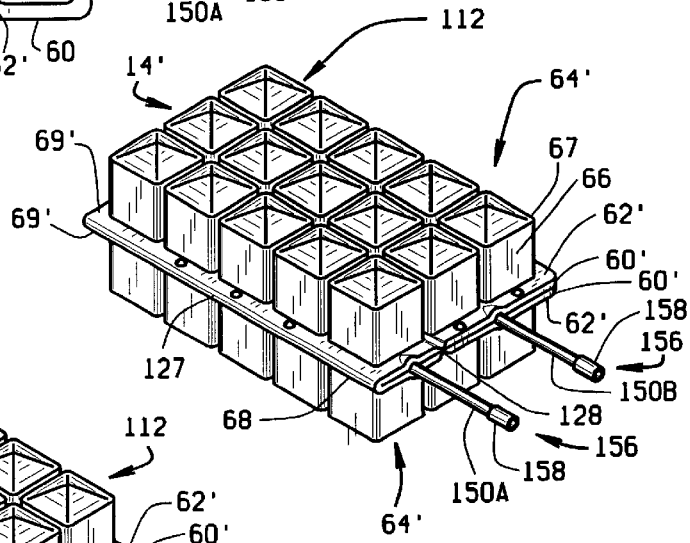
FIG. 10 is a perspective view of the air cushion of FIG. 9.
Figure 11:
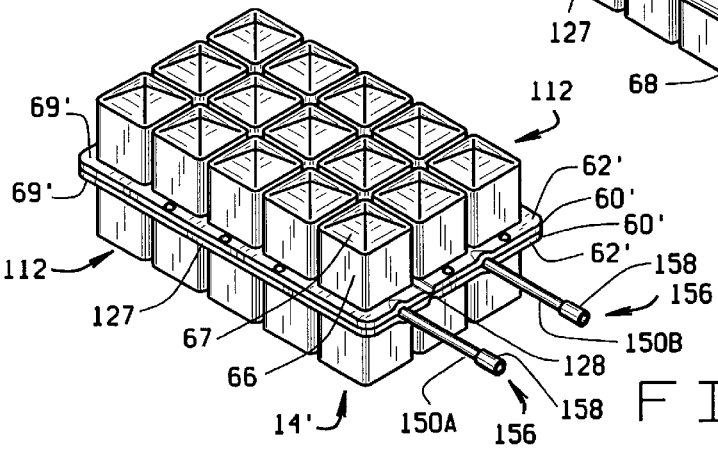
FIG. 11 is a perspective view of an alternate embodiment of the air cushion of FIG. 9.

As shown in FIGS. 10 and 11, the air cushion 14' having multiple inflation zones is preferably formed with air cells 64' extending outwardly on both sides of the air cushion 14'. The air cushion 14' is constructed in the same manner as the previously described two-section embodiment, with a pair of top sheets 62' and a pair of base sheets 60' forming the two sections 69', with one section 69' having a plurality of air cells 64' on the top of the air cushion 14' and a section 69' having a plurality of air cells 64' on the bottom of the air cushion 14'. The base sheets 60' of each section 69' are arranged side-by-side such that the independent air cells 64' of each section 69' extend outwardly and opposite from each other.

In the preferred embodiment of the air cushion 14', the inflation zones 126A, 126B on the top and bottom of the air cushion are aligned and have the same relative position on the air cushion with respect to the portion of the perimeter edge 127. Preferably, the air cells 64 in a given inflation zone on the top of the air cushion 14 communicate with the air cells 64 in the same inflation zone on the bottom of the air cushion 14. This arrangement allows the user to flip the pillow into which the cushion is inserted without discerning a difference in the level of comfort.

Figure 12:
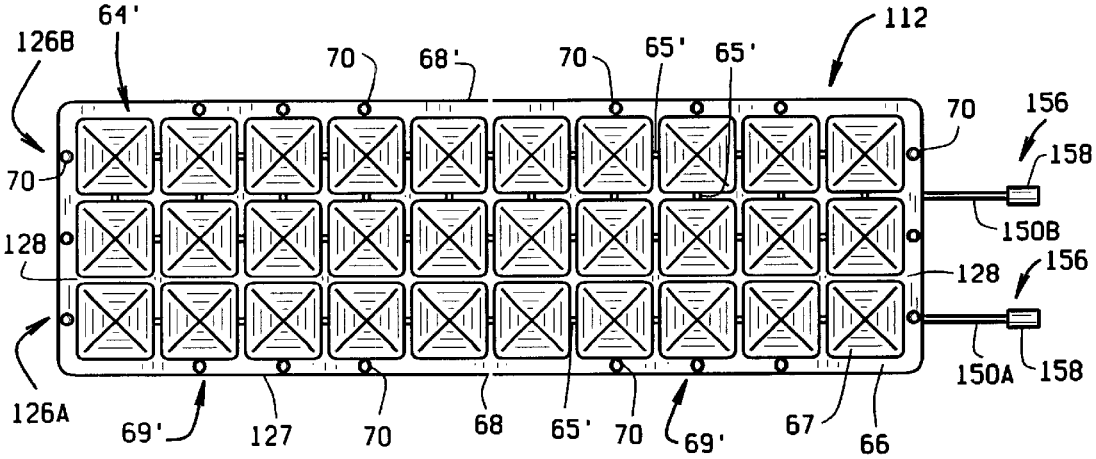
FIG. 12 is a top plan view of the inflatable cushion used to form the air cushion of FIG. 10.
Figure 13:
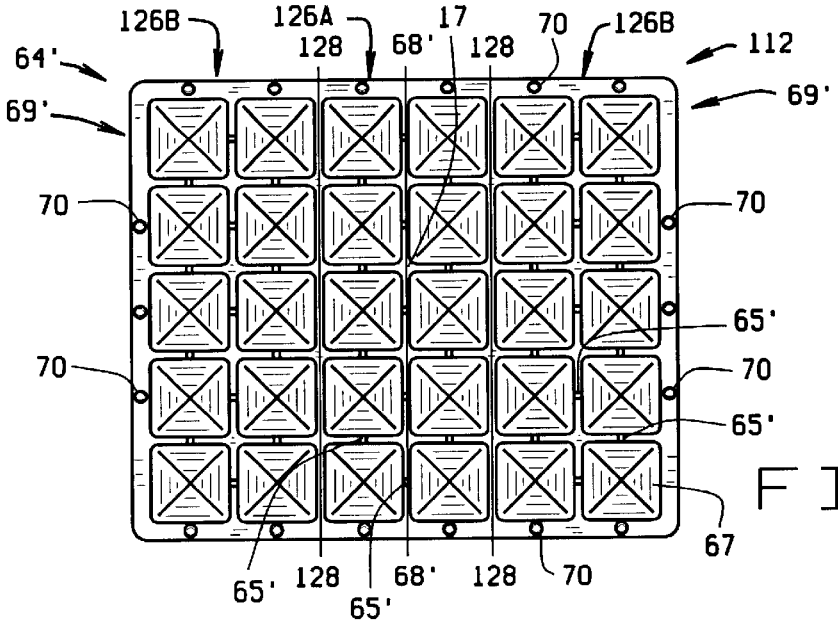
FIG. 13 is a top plan view of an alternate embodiment of the inflatable cushion used to form the air cushion of FIG. 10.

The air cushion 14' with air cells 64' extending outward from both sides of the air cushion, as shown in FIG. 10, may also be formed by folding the inflatable cushion, as described previously. Referring to FIGS. 12 and 13, the inflatable cushion 112 is preferably provided with a fold line 68' that divides the inflatable cushion into the two sections 69' so that, when the inflatable cushion 112 is folded, the sections 69' form the top and bottom of the air cushion 14'. The fold line 68' is formed in the top sheet 62' and base sheet 60' to allow the internal channel 65' between adjacent air cells 64' in a given inflation zone to remain open even when the inflatable cushion 112 is folded.

As shown in FIG. 13, the fold line 68' is arranged in a manner where the fold line 68' becomes the portion of the perimeter edge 127 of the air cushion when the inflatable cushion 112 is folded. The inflation zones 126A, 126B are arranged on the inflatable cushion 112 in the same positions on opposite sides of the fold line 68'. Two seal lines 128 are provided on opposite sides of the fold line 68' and align the air cells of the primary inflation zone 126A into a single row on opposite sides of the fold line 68'. Thus, when the inflatable cushion 112 is folded, the air cells 64' in the primary inflation zone 126A are formed on both the top and bottom sections 69 of the air cushion 14' in a row on the portion of the perimeter edge 127 on both sides of the air cushion. The air cells in the primary inflation zone on both sides of the air cushion communicate with each other so that pressure in the primary inflation zone 126A on both sides of the air cushion 14' is the same when the inflation zone is inflated.

In an alternate construction shown in FIG. 12, the fold line 68' may be positioned where it is perpendicular to the line of air cells of the primary inflation zone 126A. The seal line 128 is provided running parallel to the portion of the perimeter edge 127 to align the air cells 64 in the primary inflation zone 126A in a single row along the portion of the perimeter edge 127. When the inflatable cushion is folded to place the base sheets 60' in the side-by-side arrangement, the air cells 64' of the primary inflation zone 126A are aligned in rows on both sides of the air cushion 14' adjacent the portion of the perimeter edge 127. In this arrangement, the air cells forming both the primary and secondary inflation zones 126A, 126B on the top and bottom of the air cushion 14' remain interconnected by the internal air channels 65' despite the fold line 68', so that pressure in the inflation zones 126A, 126B on both sides of the air cushion 14 is the same when the inflation zones are inflated.

As stated previously, the air cells 64 of the inflatable cushion 112 are arranged in a three dimensional array that permits folding the inflatable cushion into the desired size and shape air cushion. In FIG. 10, the resultant air cushion 14 has air cells arranged in a 3×5×2 pattern. This pattern may be formed by folding in half an inflatable cushion 112 with an array of 6×5×1 such as the inflatable cushion 112 shown in FIG. 13. The air cushion of FIG. 10 may also be formed by folding in half an air cushion with an array of 10×3×1 as shown in FIG. 12. An air cushion with a 3×5×2 array generally has the size of a conventional pillow. The array used is dictated in part by the size of the air cushion and the thickness of the air cushion to be formed. Although, the arrays shown in the drawings are rectangular, a staggered, multi-array patterns may also be used to form a pillow having a shape other than a rectangle.

In an alternative construction, the air cushion with air cells extending outward from both sides of the air cushion may be formed by placing the base sheets 60 of two independent inflatable cushions 112 side-by-side, as shown in FIG. 11. The base sheets 60 of each separate inflatable cushion 112 are placed in the side-by-side arrangement such that the independent air cells 64 of each section 69 extend outwardly, opposite from each other. Each of the independent inflatable cushions 112 has a general construction as described previously with the top sheet 62 molded into the plurality of air cells 64 and affixed to the base sheet 60. The seal line runs parallel to the portion of the perimeter edge to form a row of air cells in the primary inflation zone 126A adjacent the portion of the perimeter edge. Each of the inflatable cushions has the same rectangular array; however, the array is smaller since the inflatable cushion 112 is not folded. In the arrangement shown in FIG. 11, the inflatable cushion 112 of each section 69 would use an array of 3×5×1 air cells.

To direct pressurized air from the inflation device 44 to the inflatable cushion 112, a flexible tube is provided that is connectable to the previously described inflation device 44. As discussed previously, the inflatable cushion 112 shown in FIG. 12 is arranged with the primary inflation zone 126A adjacent to the portion of the perimeter edge and the secondary inflation zone 126B spaced away from the portion of the perimeter edge 127 by the primary inflation zone 126A. When the inflatable cushion is folded to place the base sheets 60 in the side-by-side arrangement, the inflation zones 126A, 126B on the top of the air cushion are connected with the inflation zones on the bottom of the air cushion by the internal channels 65' that cross the fold line 68' and allow communication between the air cells 64' of a given inflation zone. Thus, the inflatable cushion shown in FIG. 12 may be supplied through a first flexible tube 150A directed to the primary inflation zone 126A and a second flexible tube 150B directed to the secondary inflation zone 126B.

In FIG. 13, the inflatable cushion 112 is formed with a primary inflation zone 126A and two secondary inflation zones 126B spaced apart from each other by the primary inflation zone 126A. Since the inflatable cushion 112 is folded about the fold line 68' to place the base sheets 60' in the side-byside arrangement, the primary inflation zone 126A may be supplied by a first flexible tube 150A directed to either one of the top and bottom sections 69' of the primary inflation zone 126A. A second flexible tube 150B is used to supply the secondary inflation zone 126B; however, in order to interconnect the spaced apart secondary inflation zones 126B on the top and bottom of the air cushion 14, a connecting conduit 152 is provided between the secondary inflation zones on the top and bottom of the air cushion 14. The second flexible tube 150B connects to the connecting conduit 152 to supply the secondary inflation zones 126B.

Figure 14:
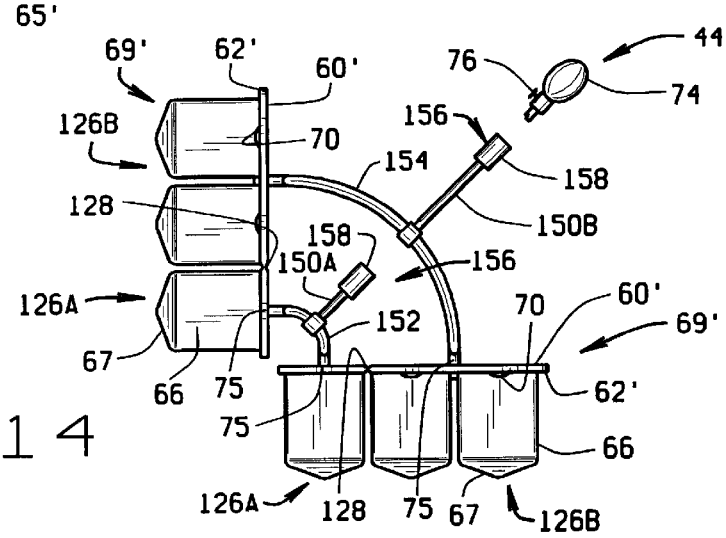
FIG. 14 is a side view of the air cushion of FIG. 11.
Figure 15:
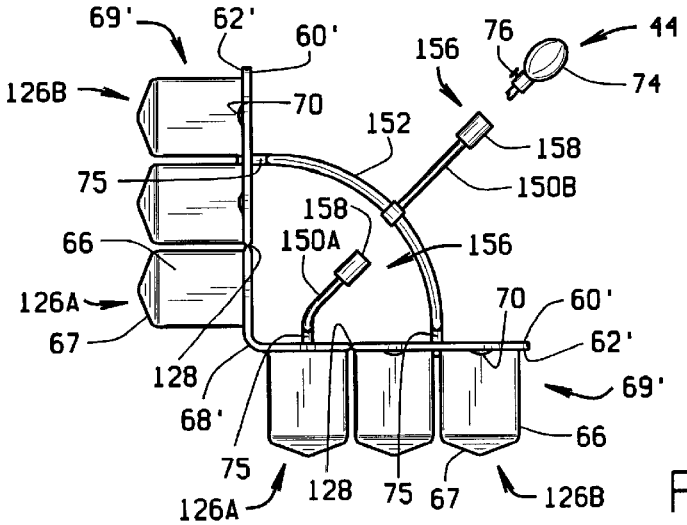
FIG. 15 is a side view of the air cushion of FIG. 10.

FIG. 14 shows the system of conduits and flexible tubes used to inflate the independent sections of the inflatable cushions 112 that form the air cushion 14 of FIG. 11. As discussed previously, each independent inflatable cushion forms a section with inflation zones that are spaced apart. A pair of conduits 152, 154 are used to interconnect each of the inflation zones 126A, 126B of the top and bottom sections 69' of the air cushion 14'. A first conduit 152 is provided to interconnect the spaced apart primary inflation zone 126A. The first conduit 152 is connected to the first flexible tube 150A that is connectable to the inflation device 44. A second conduit 154 is provided to interconnect the spaced apart secondary inflation zones 126B. The second conduct 154 is connected to the second flexible tube 150B that is connectable to the inflation device 44.

In an alternative construction, each inflation zone on top of the air cushion may be isolated from the identical inflation zone on the bottom of the air cushion. Thus, in this alternative construction, the inflation zones on the top of the air cushion would be separately inflatable from the identical inflation zone on the bottom of the air cushion.

Depending upon the arrangement of the inflation zones and whether the inflation zones on the top of the air cushion communicate with the same inflation zone on the bottom of the air cushion, other arrangements of flexible tubing and conduits may be used.

Preferably, the unfixed end 156 of the flexible tube used has a quick release fitting 158 to permit the user to rapidly install and remove the inflation device 44 from the flexible tubes when inflating and adjusting the pressure of a given inflation zone. The unfixed end 156 of the flexible tube may also be fitted with a valve to prevent deflation of the inflation zone when the inflation device 44 is removed from the unfixed end 156 of the flexible tube. Preferably, the check valve is integrally formed with the quick release fitting 158.

The conduits 152, 154 are connected to the base sheet of the air cushion and communicate with the internal air channels and each independent air cell in a given inflation zone. Preferably, as shown in FIG. 14, the conduits 152, 154 are mounted to the base sheets 60' by the elbow connection 75 discussed previously. The elbow allows the conduits 152, 154 to lay flat against the underside of the base sheets 60' so that the conduits 152, 154 may be positioned in between the base sheets 60' when the base sheets 60' are placed in the side-by side arrangement. Thus, when the base sheets 60 are held in place by the fasteners 70, the conduits 152, 154 may be stowed between the base sheets 60'.

In an alternate embodiment of the inflatable cushion where conduits are not required to inflate the inflatable cushion, a construction similar to that shown in FIG. 12, the flexible tubes 150A, 150B may be connected directly to the base sheet 60' at the edge of the base sheet without the use of elbow connections.

In operation of the preferred embodiment of the invention, the user selects the appropriate inflation zone to pressurize. The user then inflates the inflation zone by installing the inflation device 44 into quick release connection 158 at the unfixed end 156 of the flexible tube attached to the selected inflation zone. The user actuates the inflation device 44 and inflates the inflation zone to provide the air cells 64 with the desired resiliency and firmness. The user may adjust the pressure in the inflation zone by actuating the bleed valve 76 on the discharge end of the bulb pump 74 or by actuating the valve in the quick release fitting 158. When the inflation zone is pressurized as desired by the user, the user removes the inflation device 44 from the quick release connection 158 at the end 156 of the first selected flexible tube. The user then installs the discharge end of the bulb pump 74 in the unfixed end 156 of the second selected flexible tubing to begin inflation of the other inflation zones. The user repeats the process until the air cushion is inflated with each inflation zone adjusted to meet the user's needs and requirements for support.

Depending upon the type of quick release fitting installed on unfixed end 156, the user may adjust the pressure in a desired inflation zone by operating the valve integral with the quick release fitting 158 or by installing the inflation device 44 into the unfixed end 156 and operating the valve 76 on the discharge end of the bulb pump 74.

While the present invention has been described by reference to specific embodiments, it should be understood that modifications and variations of the invention may be constructed without departing from the scope of the invention as defined by the following claims.

What is claimed is:

1. An air cell pillow comprising:

an inflatable cushion having a plurality of perimeter edges and a plurality of inflation zones with one inflation zone of the plurality consisting of a single straight row of air cells arranged along a single perimeter edge of the inflatable cushion, each of the inflation zones of the plurality being isolated from each other and connected to an inflation pressure adjustment mechanism whereby each inflation zone has an inflation pressure that is independent from the inflation pressure in the other inflation zones and independently set when the cushion is inflated.

2. The pillow of claim 1 wherein:

each of the inflation zones has a plurality of air cells and the air cells in each inflation zone communicate with each other.

3. The pillow of claim 2 wherein:

the air cells in the at least one inflation zone are arranged in a row adjacent the perimeter edge.

4. The pillow of claim 3 where:

the plurality of air cells in each inflation zone is formed by a top sheet molded in the form of the plurality of air cells and secured to a base sheet, whereby the plurality of air cells extend outwardly and away from the base sheet.

5. An air cell pillow comprising:

an inflatable cushion having a perimeter edge and a plurality of inflation zones with at least one inflation zone being formed adjacent the perimeter edge of the inflatable cushion, each of the inflation zones being isolated from each other and connected to an inflation pressure adjustment mechanism whereby each inflation zone has an inflation pressure that is independent from the inflation pressure in the other inflation zones and independently set when the cushion is inflated;

each of the inflation zones has a plurality of air cells and the air cells in each inflation zone communicate with each other;

the air cells in the at least one inflation zone are arranged in a row adjacent the perimeter edge;

the plurality of air cells in each inflation zone is formed by a top sheet molded in the form of the plurality of air cells and secured to a base sheet, whereby the plurality of air cells extend outwardly and away from the base sheet; and the base sheet is one of a pair of base sheets that are positioned side-by-side and the top sheet is one of a pair of top sheets that are molded in the form of the plurality of air cells that extend outwardly from the pair of base sheets.

6. The pillow of claim 5 wherein:

the air cells formed by one of the pairs of base sheets and top sheets are in communication with the air cells formed by the other of the pairs of base sheets and top sheets.

7. The pillow of claim 5 wherein:

the inflatable cushion is folded to position the pair of base sheets in a side-by-side arrangement.

8. The pillow of claim 5 wherein:

the pair of base sheets is held in the side-by-side arrangement by releasable fasteners.

9. An air cell pillow comprising:

an inflatable cushion having a perimeter edge and a plurality of inflation zones with at least one inflation zone being formed adjacent the perimeter edge of the inflatable cushion, each of the inflation zones being isolated from each other and connected to an inflation pressure adjustment mechanism whereby each inflation zone has an inflation pressure that is independent from the inflation pressure in the other inflation zones and independently set when the cushion is inflated; and the inflatable cushion has a base and a fold line in the base and the inflatable cushion is folded over itself about the base at the fold line to form the first inflation zone on the perimeter edge of the inflatable cushion.

10. The pillow of claim 1 wherein:

each of the inflation zones is inflated by a separate conduit.

11. A pillow comprising:

an inflatable cushion having perimeter edge and a base sheet and a top sheet, the top sheet being molded in the form of a plurality of air cells that are secured to the base sheet and extend outwardly from the base sheet, the plurality of air cells including a first group of the air cells that form a first inflation zone adjacent the perimeter edge of the inflatable cushion and a second group of air cells that form a second inflation zone, the air cells of the first inflation zone being interconnected to permit air flow between the air cells in the first inflation zone, the air cells of the second inflation zone being interconnected to permit air flow between the air cells in the second inflation zone, the first inflation zone being isolated from the second inflation zone separately inflatable from the second inflation zone whereby the first inflation zone has a resiliency that is adjustable and set independently of the resiliency of the second inflation zone when the cushion is inflated.

12. A pillow comprising:

an inflatable cushion having a perimeter edge and a base sheet and a top sheet, the top sheet being molded in the form of a plurality of air cells that are secured to the base sheet and extend outwardly from the base sheet, the plurality of air cells including a first group of the air cells that form a first inflation zone adjacent the perimeter edge of the inflatable cushion and a second group of air cells that form a second inflation zone, the air cells of the first inflation zone being interconnected to permit air flow between the air cells in the first inflation zone, the air cells of the second inflation zone being interconnected to permit air flow between the air cells in the second inflation zone, the first inflation zone being isolated from the second inflation zone and separately inflatable from the second inflation zone whereby the first inflation zone has a resiliency that is adjustable and set independently of the resiliency of the second inflation zone when the cushion is inflated; and the base sheet is one of a pair of base sheets that are positioned side-by-side of each other and the top sheet is one of a pair of top sheets that are molded in the form of the plurality of air cells that extend outwardly from the pair of base sheets.

13. The pillow of claim 12 wherein:

the first inflation zone is one of a pair of first inflation zones formed in each base and top sheet and the pair of first inflation zones is interconnected by a conduit.

14. The pillow of claim 12 wherein:

the inflatable cushion is folded to position the pair of base sheets in a side-by-side arrangement.

15. The pillow of claim 12 wherein:

the first and second inflation zones are pressurized by separate tubes.

16. The pillow of claim 15 wherein:

the pair of base sheets is held in the side-by-side arrangement by releasable fasteners.

17. The pillow of claim 16 wherein:

the tubes are positioned in between the pair of base sheets when the base sheets are secured in the side-by-side arrangement.

18. The pillow of claim 12 wherein:

the inflatable cushion is folded to form the first inflation zone on the perimeter edge of the inflatable cushion.

19. The pillow of claim 12 wherein:

the air cells formed adjacent the perimeter edge of the inflatable cushion are arranged in a row adjacent the perimeter edge of the inflatable cushion.

20. A pillow comprising:

an inflatable cushion having first and second base sheets and first and second top sheets, the first and second base sheets are positioned side-by-side of each other, the first and second top sheets are each molded in a form of a plurality of independent air cells that are secured to the respective first and second base sheets and extend outwardly in opposite directions from the first and second base sheets, the air cells being grouped into a plurality of sections with at least one section being formed along a perimeter edge of the inflatable cushion, each of the sections being separated from the other sections in a manner to prevent communication between the sections whereby each section has an associated firmness that is adjustable.

21. The pillow of claim 20 wherein:

the at least one section has a fold line and the inflatable cushion is folded about the fold line to configure the base sheets in the side-by-side arrangement with the at least one section positioned adjacent the perimeter edge of the inflatable cushion.

22. The pillow of claim 21 wherein:

the first and second base sheets are attached together by releasable fasteners.

* * * * *